US006260343B1

(12) United States Patent
Pourladian

(10) Patent No.: US 6,260,343 B1
(45) Date of Patent: Jul. 17, 2001

(54) HIGH-STRENGTH, FATIGUE RESISTANT STRANDS AND WIRE ROPES

(75) Inventor: Bamdad Pourladian, St. Joseph, MO (US)

(73) Assignee: Wire Rope Corporation of America, Incorporated, St. Joseph, MO (US)

( * ) Notice: Subject to any disclaimer, the term of this patent is extended or adjusted under 35 U.S.C. 154(b) by 0 days.

(21) Appl. No.: 09/301,069

(22) Filed: Apr. 28, 1999

Related U.S. Application Data

(60) Provisional application No. 60/083,800, filed on May 1, 1998.

(51) Int. Cl.[7] ..... D02G 3/02

(52) U.S. Cl. ..... 57/200; 57/13; 57/15; 57/139; 57/201; 57/206; 57/207; 57/210; 57/214; 57/248; 57/253; 174/113

(58) Field of Search ..... 57/13, 15, 139, 57/200, 201, 206, 207, 210, 214, 248, 253, 145, 166, 161; 174/113

(56) References Cited

U.S. PATENT DOCUMENTS

| | | | | |
|---|---|---|---|---|
| Re. 29,537 | * | 2/1978 | Adams | 57/148 |
| 3,048,963 | * | 8/1962 | Himmelfarb et al. | 57/140 |
| 3,130,536 | * | 4/1964 | Peterson et al. | 57/214 |
| 3,257,792 | | 6/1966 | Joy . | |
| 3,283,494 | | 11/1966 | Lucht et al. . | |
| 3,395,528 | | 8/1968 | Lucht . | |
| 4,612,792 | | 9/1986 | DeBondt et al. . | |
| 4,635,432 | | 1/1987 | Wheeler . | |
| 4,676,058 | * | 6/1987 | Foley et al. | 57/218 |
| 6,023,026 | | 2/2000 | Funahashi et al. . | |

OTHER PUBLICATIONS

"Thermomechanical Surface Hardening Raises Spring Life," Advanced Materials & Processes 3/99, p. 17.

S. R. Bhonsle et al, "Mechanical Fatigue Properties of Stress Relieved Type 302 Stainless Steel Wire," Journal of Materials Engineering and Performance, vol. 1, No. 3, 6/92, pp. 363–369.

* cited by examiner

*Primary Examiner*—John J. Calvert
*Assistant Examiner*—Shaun R Hurley
(74) *Attorney, Agent, or Firm*—Oliff & Berridge, PLC

(57) ABSTRACT

Strands and wire ropes composed of materials such as high carbon steels and stainless steels can be provided in a compacted, mechanically stress relieved and thermally stress relieved condition. The wires are compacted during stranding to form the individual strands of the wire ropes. The wires can be thermally stress relieved prior to stranding to remove tensile residual stresses. Compaction produces a compressive residual stress state in the strands which increases fatigue resistance. The strands can be thermally stress relieved subsequent to closing. The wires and strands can be heated using a process such as induction heating. The wire ropes can be torque balanced or rotation resistant. The wire ropes have high strength, a high strength-to-weight ratio and enhanced fatigue life. Stainless steel wire ropes also provide corrosion resistance.

27 Claims, 3 Drawing Sheets

HIGH-STRENGTH, FATIGUE RESISTANT STRANDS AND WIRE ROPES

This nonprovisional application claims the benefit of U.S. Provisional Application No. 60/083,800, filed May 1, 1998.

BACKGROUND OF THE INVENTION

1. Field of the Invention

This invention relates to improved high-strength, fatigue resistant strands and wire ropes. This invention also relates to methods for making the strands and wire ropes.

2. Description of the Related Art

Strands and wire ropes are used in a wide range of applications for lifting and holding objects. For example, wire ropes are used in cranes as lifting elements and as pendants to support the boom. Most standard wire ropes comprise six outer strands surrounding a central core. Three-strand wire ropes are specifically designed to reduce rotation under load. These wire ropes have been used in tower cranes where torque generation in the ropes needs to be minimized for better rope performance.

Wire ropes are produced from various metals that can be drawn into small-diameter wire and have sufficient ductility for the forming process. Presently, high-carbon wires are used in strands and wire ropes. Other metals that are used include stainless steels, copper, aluminum and other alloys. The most commonly used materials for wire ropes are high-carbon steels and stainless steels. High-carbon steel wire ropes can be used in applications and environments in which corrosion is not a major concern. High-carbon steel wire ropes can be galvanized for corrosion resistance. In addition, high-carbon steel wire ropes can be compacted for use in applications requiring higher strength and improved crush resistance and fatigue life.

Desired properties for strands and wire ropes include high strength; high strength-to-weight ratio to reduce the weight of the wire rope having sufficient strength for a given use; high fatigue life to withstand repeated stresses; and suitable bending stiffness. In addition, reduced rotation under load is also desired for better performance.

There is a need for improved strands and wire ropes that have improved properties and can be provided in various material compositions. There is also a need for a method of making the improved strands and wire ropes.

SUMMARY OF THE INVENTION

This invention provides improved strands and wire ropes that satisfy the above needs. This invention also provides methods of making the improved strands and wire ropes. The strands and wire ropes according to exemplary embodiments of this invention provide increased strength; increased strength-to-weight ratio; increased fatigue life; suitable stiffness; corrosion resistance and rotation resistance or torque balance.

Strands according to exemplary embodiments of this invention comprise a plurality of wires in a compacted, mechanically stress relieved and thermally stress relieved condition. Compaction produces compressive residual stress in the outer wires of the strands and increases strength and fatigue life. The strands can comprise high-carbon steels, stainless steels and other suitable metals.

Strands according to exemplary embodiments of this invention comprise a plurality of thermally stress relieved stainless steel wires.

Wire ropes according to exemplary embodiments of this invention comprise a plurality of strands. The wire ropes can be in a mechanically stress relieved and thermally stress relieved condition.

The wire ropes can comprise a core and can be rotation resistant. Torque balanced wire ropes can comprise three or more strands.

Stainless steel wire ropes and high carbon steel wire ropes can be provided in a compacted mechanically stress relieved condition and, optionally, also in a thermally stress relieved condition.

The compacted stainless steel strands and wire ropes have a strength level which is comparable to the strength level of thermally stress relieved stainless steel wire ropes of the same diameter. Mechanically and thermally stress relieved stainless steel strands and wire ropes have improved mechanical properties including enhanced breaking strength as compared to compacted, but non-thermally stress relieved, stainless steel wire rope.

Exemplary embodiments of the methods of this invention comprise heating a plurality of wires to thermally stress relieve the wires; and stranding the wires to form strands. The wires are compacted during stranding to mechanically stress relieve the strands.

Exemplary embodiments of the methods of this invention can further comprise closing a plurality of strands to form a wire rope. In embodiments, the wire ropes can optionally be compacted and/or thermally stress relieved to produce finished ropes.

BRIEF DESCRIPTION OF THE DRAWINGS

This invention will be described herein with reference to the appended figures in which like elements are identified with like reference numbers, and wherein.

DETAILED DESCRIPTION OF PREFERRED EMBODIMENTS

This invention provides improved strands and wire ropes. This invention separately provides methods of making the strands and wire ropes.

Figure 1:
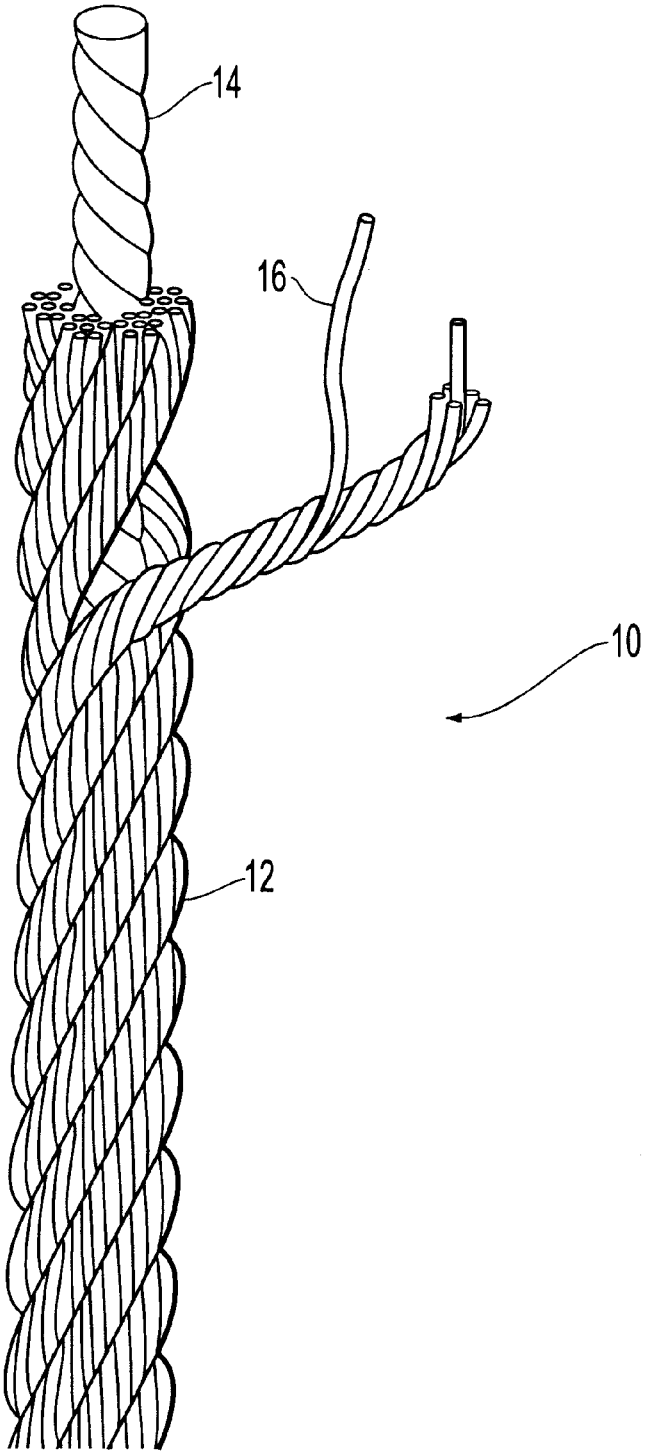
FIG. 1 illustrates a conventional multi-strand wire rope including a core.

FIG. 1 illustrates a conventional multi-strand wire rope 10. The wire rope 10 comprises a plurality of strands 12 arranged in a spiraled configuration about a central core 14. Such wire ropes 10 typically comprise three, four or six strands 12, and each of the individual strands 12 can include multiple wires, for example, 19 to 49 wires 16.

Conventional torque balanced wire ropes do not include a core and typically comprise three or four strands. Torque balanced ropes can comprise more than four strands as well.

As explained, torque balanced wire ropes are used in application in which rotation of the ropes and twisting of loads needs to be minimized, such as during the lifting of heavy objects, or lifting objects to tall heights such as in towers and like structures.

Figure 2:
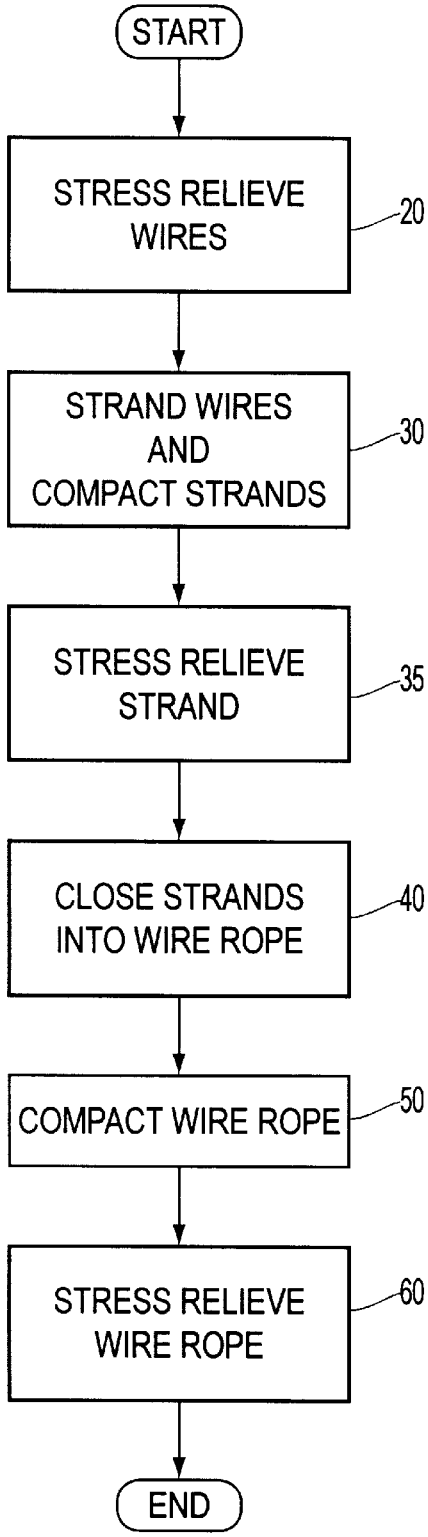
FIG. 2 is a flow diagram of an exemplary embodiment of a method of making strands and wire ropes according to this invention.

FIG. 2 schematically illustrates a method of forming strands and wire ropes according to an exemplary embodiment of this invention. The method comprises initially providing a plurality of wires, such as 19 to 49 wires, depending on the particular strand to be produced. According to an aspect of this invention, improved strands and wire ropes are manufactured from suitable metals including high-carbon steels and stainless steels such as 302 and 304 type austenitic stainless steels (SS302 and SS304, respectively). Stainless steels are advantageous for use in corrosive environments to enhance the service life of the wire ropes. Other suitable metals such as copper-based materials, aluminum and other steels can be used to form the strands and wire ropes.

The wires are heated at a suitable temperature and for a sufficient amount of time at temperature during the step 20 of stress relieving the wires. Stress relieving is a time-at-temperature process; accordingly, the higher the temperature, the shorter is the heating time that is needed to stress relieve the wires. According to an aspect of this invention, the wires can be stress relieved in an induction furnace. Induction heating provides the advantage of heating the wires significantly faster than batch type heating devices. Consequently, the heating time can be reduced by induction heating. In addition, induction heating can be performed in a continuous in-line process on wires. Batch type heating can be used for wires on spools.

The stress relief temperature that is used for the wires depends on the wire composition. For example, type SS302 and SS304 stainless steel wires can be stress relieved at a temperature in a range of from about 700° F. to about 1,200° F. High-carbon steel wire ropes (AISI 1075–AISI 1095) are typically stress relieved at a temperature in the range of from about 675° F. to about 1,000° F. The higher the temperature within the range that is used, the shorter is the heating time to achieve stress relief of the wires.

Thermal stress relieving removes surface tensile residual stresses on cold-drawn wires. The removal of these tensile stresses improves fatigue life and tensile strength of the wires.

The heat treated wires are typically wound onto spools. The spools are then transferred to stranding station to perform step 30. The step 30 comprises stranding the wires into strands (or cables). The wires can be stranded using any suitable strander such as tubular stranders and the like.

According to an aspect of this invention, the wires can be stranded and compacted during the same operation. That is, during step 30 the wires are passed through a stranding and compacting die to strand and compact the stress relieved wires. Compacting the wires imparts a surface compressive residual stress state to the outer wires of the strands, which further increases the fatigue life of the strands and wire ropes according to this invention. Increasing the fatigue life is advantageous for all wires and is particularly advantageous for stainless steel wires. Stainless steel wires are more sensitive to residual stresses and have a lower fatigue life than high-carbon steel wires. Accordingly, stainless steel strands and wire ropes benefit significantly from being compacted to increase their fatigue life.

The amount of compaction of the strands at the strander is related to the decrease in diameter of the strands. The required compaction for a given desired or design strength is a function of wire strength, and the efficiency of translating wire aggregate strength into rope strength. Typically, the reduction in diameter of the strands can be from about 2% to about 9% to achieve the desired rope strength.

Combining the steps of stranding and compacting the strands into a single operation eliminates the need to add an additional step to the process. Thus, exemplary embodiments of the methods of forming strands and wire ropes according to this invention provide significant cost advantages as compared to having to perform the steps in separate operations to achieve the desired strand properties.

Figure 3A:
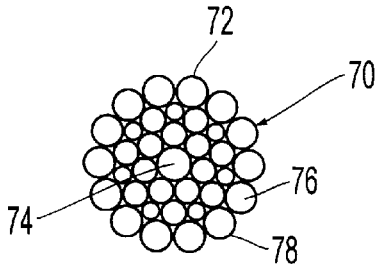
FIG. 3A is a cross-sectional view of a strand prior to compaction according to an exemplary embodiment of this invention.
Figure 3B:
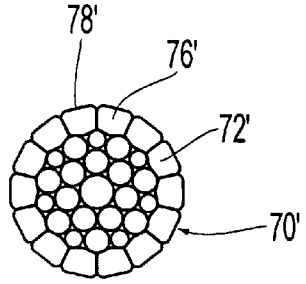
FIG. 3B illustrates the strand of FIG. 3A following compaction.

The effect of compaction of the strands on the shape of the wires is shown in FIGS. 3A and 3B. FIG. 3A illustrates the shape of a strand 70 prior to compaction. The wires 72 surrounding the center wire 74 are round, and the outer wires 76 of the strand 70 includes semi-circular surface portions.

FIG. 3B illustrates the shape of the wires 72' in the strand 70' after compaction at the strander. As shown, the wires 72' are deformed. The outer wires 76' of the strand 70' have flattened outer faces 78', which have a compressive residual stress state. The compressive residual stress state of the outer surfaces of the wires improves the fatigue life and tensile strength of the strands as compared to strands that are not compacted.

Following stranding and compaction of the wires to form strands, the strands can optionally be stress relieved as indicated at step 35.

After step 30 or optional step 35, the strands are transferred to a closing station as depicted at step 40. In step 40, a plurality of the stress relieved and compacted strands are closed to form wire ropes. The closing step can be performed in any suitable closing apparatus such as a planetary closer or the like.

The wire ropes formed during step 40 can comprise various numbers of strands and can optionally include a core. To produce rotation resistant wire ropes, a plurality of the strands are cross-layed around a core. Torque balanced wire ropes formed according to exemplary embodiments of the methods of this invention typically comprise three, four or more strands arranged in a spiraled arrangement.

Figure 4A:
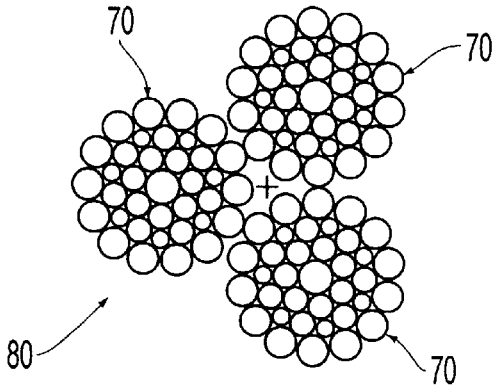
FIG. 4A is a cross-sectional view of a wire rope including strands in a non-compacted condition.

A cross-section of a conventional wire rope 80 comprising three non-compacted strands 70 is illustrated in FIG. 4A.

Figure 4B:
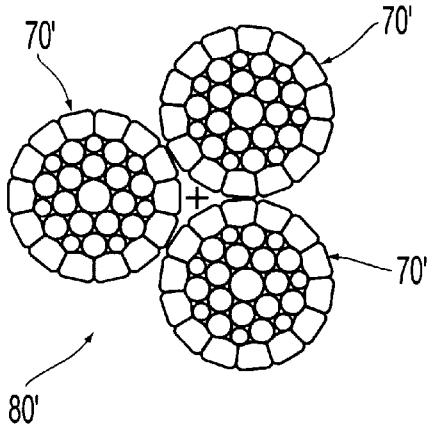
FIG. 4B illustrates a wire rope including compacted strands according to an exemplary embodiment of this invention.

FIG. 4B illustrates a three-strand wire rope 80' made according to an exemplary embodiment of this invention, including three compacted strands 70' as shown in FIG. 3B. The wire rope 80' has about the same outer diameter as the conventional wire rope 80. As explained, the compacted strands 70' have increased strength and fatigue life as compared to the strands 70 of the wire rope 80 in FIG. 4A. Accordingly, the wire rope 80' also provides these improved properties. In addition, the wire rope 80' has a greater metallic area than the wire rope 80, due to the compacted shape of the strands 70'.

According to another aspect of this invention, following step 40 of closing the strands to form wire ropes, the wire ropes can be subjected to an optional compaction step 50 and/or an optional stress relieve step 60. These optional steps can be selectively performed to affect the surface residual stress state of the wire ropes as explained above.

To demonstrate the advantages of wire ropes manufactured according to exemplary embodiments of this invention, experimental testing was conducted on stainless steel wire ropes. A three-strand, ⅝ inch diameter type 304 stainless steel wire rope was tested to determine the effect of the stress relieving temperature on the mechanical properties of as manufactured wire rope. Wire ropes were induction heated to temperatures of 700° F., 800° F., 900° F. and 1000° F. The test results are below in TABLE 1.

TABLE 1

| Stress Relief Temperature | Breaking Strength | % Increase |
|---|---|---|
| As Manufactured | 37,000 lbs | 0 |
| 700° F. | 39,400 lbs | 6.5 |
| 800° F. | 39,900 lbs | 7.8 |
| 900° F. | 40,500 lbs | 9.5 |
| 1000° F. | 38,800 lbs | 4.9 |

The data show that the wire rope stress relieved at 900° F. had the highest breaking strength. The breaking strength of this wire rope was about 10% higher than that of the as-manufactured wire rope. The wire rope stress relieved at 1000° F. had the highest elongation, which was about 3.4% higher than that of the as-manufactured wire rope.

Thus, these results indicate that stress relieving stainless steel wire ropes significantly improves their strength and ductility.

A compacted three-stand wire rope having a nominal diameter of 9/16 inch was also produced from the same wires and strands as the 5/8 inch diameter ropes. This compacted wire rope demonstrated the important finding that it is possible to manufacture compacted stainless steel wire ropes. Tensile testing of the compacted wire rope showed that this rope had a slightly higher breaking strength than the non-compacted 5/8" diameter counterpart.

Further in accordance with this invention, a three-strand, ½ inch diameter, type 304 stainless steel wire rope was produced in a mechanically stress relieved and thermally stress relieved condition to demonstrate the advantage of performing both of these operations. The compacted wire rope was stress relieved at about 800° F. for about 6 hours. The tensile strength of the wire rope before stress relief was about 24,000 lbs. After stress relief, the wire rope had a tensile strength of about 32,000 lbs, which is an increase of about 33%.

Tests were also conducted to demonstrate the improvement in fatigue life In compacted stainless steel wire ropes according to this invention. Compacted three-strand, 9/16 inch diameter, type 304 stainless steel wire rope was determined to have a significantly higher fatigue life during reverse-bend fatigue testing, than three-strand 5/8 inch diameter, type 304 stainless steel wire ropes stress-relieved at 900° F. and in a non-compacted condition. Particularly, the compacted 9/16 inch diameter wire rope failed at 3,400 cycles, while the 5/8 inch diameter, stress relieved and non-compacted wire rope failed at 1,100 cycles.

A series of tests were also conducted on six different wire ropes. Each of these wire ropes had a finished nominal diameter of about ½ inch and a similar angle of lay. The wire ropes each included three strands each having thirty-six wires as shown in FIGS. 4A and 4B.

Tensile break tests and reverse-bend fatigue tests were performed on the wire ropes having six different rope conditions. TABLE 2 below summarizes the characteristics of each rope condition.

TABLE 2

| Wire Rope Condition | Wire Material | Wires Heat-Treated | Compacted Strands | Outside Wire Dia. | Total Metallic Area ($in^2$) | Weight/ /Foot (lb/ft) |
|---|---|---|---|---|---|---|
| 1 | SS304 | Yes | Yes | 0043" | 01196 | 0438 |
| 2 | SS304 | No | Yes | 0.043" | 0.1196 | 0.438 |
| 3 | SS304 | No | No | 0.041" | 0.1113 | 0.408 |
| 4 | 1075C | No | Yes | 0.043" | 0.1196 | 0.427 |
| 5 | 1075C | Yes | Yes | 0.043" | 0.1196 | 0.427 |
| 6 | 1075C | No | No | 0.041" | 0.1113 | 0.397 |

The wire rope conditions 1 and 5 combine heat-trated wires and compacted strands. Wire rope conditions 1 and 2 were produced from the same batch of wires. The wires used to produce wire rope condition 2 were in as-drawn condition. The wires used to produce wire rope condition 1 were heat treated at 900° F. for six hours. Similarly, the wires used to produce wire rope conditions 4 and 5 were from the same batch. The wires for wire rope condition 4 were in the as-drawn state. The wires for wire rope condition 5 were heat-treated at 700° F. for three hours.

Two samples of each wire rope condition 1 to 6 were tensile tested to failure to determine the tensile breaking strength. Also, wire samples were removed from each spool prior to the stranding operation. These wire samples were tensile tested to determine the average strength of each wire size being used to produce the wire ropes. Based on the average strength determined for each wire size, an aggregate strength (sum of the tensile strengths of all thirty-six wires multiplied by three) for each wire rope was calculated. The rope (breaking strength) efficiency of each rope was also calculated by dividing the actual breaking strength (average of two tests) of the wire the calculated aggregate strength of the wires. TABLE 3 summarizes the test results for all six wire rope conditions.

TABLE 3

| Wire Rope Condition | Breaking Strength (lb.) (A) | Aggregate Strength (lb.) (B) | Rope Efficiency [(A)/(B)] × 100 |
|---|---|---|---|
| 1 | 31,300 | 38,445 | 81.4% |
| 2 | 27,600 | 35,292 | 78.2% |
| 3 | 24,300 | 32,064 | 75.8% |
| 4 | 33,800 | 40,488 | 83.5% |
| 5 | 32,900 | 38,850 | 84.7% |
| 6 | 30,300 | 37,071 | 81.7% |

As shown in TABLE 3, both high strength and higher efficiencies were observed for wire rope conditions 1 and 5. Also the breaking strength value of 31,300 pounds for wire rope condition 1 was very close to the breaking strength of about 32,000 pounds for the above-described ½ inch diameter compacted-strand-stainless-steel (SS304) wire rope. However, for the above-described wire rope, the heat-treatment was performed on a finished rope sample. condition 1 utilized heat-treated wires, and no final heat-treatment to the finished wire rope was performed.

To measure the fatigue resistance of the wire rope conditions 1 to 6, six reverse-bend fatigue samples were tested for each wire rope condition. The tests on these ½ inch ropes were conducted on 12 inch pitch diameter sheaves. The tensile load on all wire rope samples was kept constant at 8000 pounds. A given length of rope sample was cycled back-and-forth through a three sheave system until rope failure occurred. The number of cycles-to-failure was determined for the six test sample of each wire rope condition.

The highest and lowest values were discarded, and the remaining four data points were used to calculate the average number of cycles-to-failure. TABLE 4 shows these average values as well as the standard deviation for each case. The breaking strength of each wire rope condition is shown for comparison purposes. Strength-to-weight ratio values are also shown.

TABLE 4

| Wire Rope Condition | Breaking Strength (psi) | Reverse-bend fatigue No. Cycles-to-failure | Strength-to-weight ratio [(Breaking strength)/(Weight per foot)] |
|---|---|---|---|
| 1 | 261,706 | 7,848 ± 909 | 71,461 |
| 2 | 230,769 | 8,493 ± 691 | 63,014 |
| 3 | 218,329 | 4,742 ± 110 | 59,559 |
| 4 | 282,609 | 10,838 ± 250 | 79,157 |
| 5 | 275,084 | 11,681 ± 244 | 77,049 |
| 6 | 272,237 | 5,279 ± 460 | 76,322 |

As shown in TABLE 4, the best combination of high strength and fatigue resistance was for the wire ropes that were produced from heat-treated wires and compacted strands; i.e., wire rope conditions 1 and 5. The combination of these two values for the wire rope conditions 3 and 6, for which the wires were not heat-treated and strands were not compacted, were significantly poorer than for the wire rope conditions 1 and 5.

In order to quantify the axial surface residual stresses in the outer wires of the above wire ropes, an X-ray diffraction method of measurement was used. These measurements were conducted on samples of the strands prior to compaction (S1–S6), samples of strands after compaction (F1, F2, F4 and F5), and samples of wire ropes (R1–R6). TABLE 5 and TABLE 6 show the measured values of axial surface residual stress for the high carbon steel and 304 stainless steel samples, respectively. For each sample, four data points were measured. These data points were measured at four circumferentially spaced locations, separated from each other by 90°.

TABLE 5

(HIGH CARBON STEEL)

| Test Location Sample | 0° Stress (ksi) | 90° Stress (ksi) | 180° Stress (ksi) | 270° Stress (ksi) |
|---|---|---|---|---|
| S4 | −48.7 ± 9 | −37.3 ± 14 | −16.2 ± 10 | −42 ± 10 |
| S5 | −16.3 ± 5 | −26.8 ± 9 | −15.4 ± 5 | −34.1 ± 9 |
| S6 | −31.8 ± 9 | −1.8 ± 11 | −14.3 ± 7 | −31.1 ± 11 |
| F4 | −63.1 ± 5 | −67.1 ± 10 | −68.8 ± 6 | −76 ± 7 |
| F5 | −29.4 ± 9 | −64 ± 6 | +33.7 ± 6 | −79.4 ± 6 |
| R4 | −34.8 ± 4 | — | −42 ± 6 | — |
| R5 | −41.6 ± 6 | — | −34.8 ± 4 | — |
| R6 | −40 ± 14 | — | −20 ± 8 | — |

TABLE 6

(304 STAINLESS STEEL)

| Test Location Sample | 0° Stress (ksi) | 90° Stress (ksi) | 180° Stress (ksi) | 270° Stress (ksi) |
|---|---|---|---|---|
| S1 | +29.4 ± 7 | −4.9 ± 5 | +10.2 ± 10 | −38.0 ± 4 |
| S2 | +20.7 ± 5 | +29.8 ± 2 | −5.1 ± 7 | −12 ± 7 |
| 53 | −42.4 ± 4 | −50.3 ± 7 | −18.6 ± 5 | −53 ± 7 |
| F1 | −60.3 ± 8 | −79 ± 5 | −54 ± 5 | −17.3 ± 6 |

TABLE 6-continued (304 STAINLESS STEEL)

| Test Location Sample | 0° Stress (ksi) | 90° Stress (ksi) | 180° Stress (ksi) | 270° Stress (ksi) |
|---|---|---|---|---|
| F2 | −64.1 ± 10 | −23.2 ± 8 | −76.1 ± 7 | −49.4 ± 5 |
| R1 | −24.4 ± 4 | — | −8.5 ± 4 | — |
| R2 | −62.4 ± 4 | — | −35.4 ± 4 | — |
| R3 | −57.6 ± 8 | — | −51.0 ± 4 | — |

For the compacted strands (F1, F2, F4 and F5), the highest compressive residual stress values were observed on the outer surface of the outer wires in these strands. This is a very important factor in fatigue crack initiation life. The results also show that the magnitude of surface residual stress was significantly altered for outer wires as they were exposed to various manufacturing processes such as heat-treatment, stranding and closing.

Although the data was developed for ½ inch, 3×36 (three-strand wire ropes), the basic findings are expected to also be valid for typical six-strand ropes and many other type and constructions of strands and wire ropes.

Strands and wire ropes according to this invention can be used in various applications in which their improved properties are advantageous. Torque-balanced, three-strands stainless steel wire ropes have a lower rotational tendency than conventional six-strand wire ropes. As described above, stress relieving and compacting the strands provides added strength and fatigue resistance. For a given rope diameter, three-strand wire ropes according to exemplary embodiments of this invention have a higher strength to weight ratio than conventional six-strand ropes or other multi-strand, rotation resistant ropes. In addition, because the wire ropes include only three strands, they are less expensive to manufacture than the standard six-strand wire ropes.

The improved strength-to-weight ratio and improved fatigue life makes the strands and wire ropes according to this invention particularly suitable for applications requiring these properties, as well as rotation resistance and torque balance provided by these wire ropes. For example, the wire ropes according to this invention can be used in tower cranes, deep-shaft mine hoists, deep sea moorings, long-span bridge cable stays and suspension cables. For applications that do not use or do not require stainless steel, drawn galvanized wire ropes can be used. Single-part ropes can be used in aerial lifts and winches, for example.

The principals, preferred embodiments and modes of operation of this invention are described in the foregoing specification. The invention which is intended to be protected herein shall not, however, be construed as limited to the particular forms disclosed, as these are to be regarded as illustrative rather than restrictive. Variations and changes may be made by those skilled in the art without parting from the spirit of the invention.

What is claim is:

1. A strand comprising a plurality of stainless steel wires, which are in a compacted, mechanically stress relieved condition the plurality of stainless steel wires comprising outer wires including outer surfaces having a compressive residual stress state.

2. The strand of claim 1, wherein the plurality of stainless steel wires are in a mechanically stress relieved and thermally stress relieved condition.

3. A wire rope comprising a plurality of the strands according to claim 2.

4. A wire rope comprising a plurality of the strands according to claim 1.

5. The wire rope of claim 4, wherein the wire rope comprises at least three strands and is torque balanced.

6. The wire rope of claim 3, wherein the wire rope comprises at least three strands and is torque balanced.

7. A strand comprising a plurality of metal wires, which are in a compacted, mechanically stress relieved and thermally stress relieved condition, the plurality of metal wires comprising outer wires including outer surfaces having a compressive residual stress state.

8. The strand of claim 7, wherein the plurality of metal wires comprise high-carbon steel.

9. A wire rope comprising a plurality of the strands according to claim 8.

10. A wire rope comprising a plurality of the strands according to claim 7.

11. The wire rope of claim 10, wherein the wire rope comprises at least three strands and is torque balanced.

12. The wire rope of claim 9, wherein the wire rope comprises at least three strands and is torque balanced.

13. The wire rope of claim 10, further comprising a core surrounded by the strands, and wherein the wire rope is rotation resistant.

14. The wire rope of claim 9, further comprising a core surrounded by the strands, and wherein the wire rope is rotation resistant.

15. A method, comprising:

heating a plurality of wires to thermally stress relieve the wires; and stranding the wires to form at least one strand, wherein the wires are compacted during the stranding so as to mechanically stress relieve the at least one strand;

wherein the at least one mechanically stress relieved strand comprising outer wires including outer surfaces having a compressive residual stress state.

16. The method of claim 15, wherein the stranding comprises stranding the wires to form a plurality of strands, the wires being compacted during the stranding so as to mechanically stress relieve the strands; and the method further comprises closing the plurality of strands to form a wire rope.

17. The method of claim 16, further comprising heating the wire rope to thermally stress relieve the wire rope.

18. The method of claim 17, wherein the wire rope comprises at least three strands, and the wire rope is torque balanced.

19. The method of claim 16, wherein the wire rope comprises at least three strands, and the wire rope is torque balanced.

20. The method of claim 17, wherein the wires comprise stainless steel.

21. The method of claim 16, wherein the wires comprise stainless steel.

22. The method of claim 16, further comprising:

providing a core; and arranging the plurality of strands so as to surround the core and form the wire rope.

23. A method of making a torque balanced, stainless steel wire rope, comprising:

providing at least three strands comprised of stainless steel, the strands being in a mechanically stress relieved and thermally stress relieved condition and the strands comprising outer wires including outer surfaces having a compressive residual stress state; and closing the strands to form a torque balanced wire rope.

24. The wire rope of claim 9, wherein the wire rope comprises three strands and has a breaking strength of 275,084 psi.

25. The wire rope of claim 24, wherein the wire ropes has a reverse-bend fatigue number of cycles to failure of 11,681, as determined on 12 inch pitch diameter sheaves and by applying a constant tensile load of 8000 pounds on the wire rope.

26. The wire rope of claim 3, wherein the wire rope comprises three strands and has a breaking strength of 261,706.

27. The wire rope of claim 26, wherein the wire ropes has a reverse-bend fatigue number of cycles to failure of 7,848, as determined on 12 inch pitch diameter sheaves and by applying a constant tensile load of 8000 pounds on the wire rope.

* * * * *